United States Patent [19]

Lavoie

[11] 4,279,558

[45] Jul. 21, 1981

[54] BAG OPENING APPARATUS

[76] Inventor: Gilbert V. Lavoie, 311 Elm St., Raynham, Mass. 02767

[21] Appl. No.: 967,915

[22] Filed: Dec. 11, 1978

[51] Int. Cl.[3] ..... B65B 69/00; B65G 65/00

[52] U.S. Cl. ..... 414/412; 198/624; 241/278 A

[58] Field of Search ..... 414/412, 297; 241/278 A; 198/624; 209/308

[56] References Cited

U.S. PATENT DOCUMENTS

| | | | |
|---|---|---|---|
| 1,840,803 | 1/1932 | Babare | 241/278 A |
| 2,617,532 | 11/1952 | Gorton | 209/308 |

FOREIGN PATENT DOCUMENTS

| | | | |
|---|---|---|---|
| 2012814 | 9/1971 | Fed. Rep. of Germany | 414/412 |
| 2218026 | 4/1972 | Fed. Rep. of Germany | 414/412 |
| 2554659 | 6/1977 | Fed. Rep. of Germany | 414/412 |

*Primary Examiner*—Leslie J. Paperner
*Assistant Examiner*—L. E. Williams
*Attorney, Agent, or Firm*—John E. Toupal

[57] ABSTRACT

The invention is a bag opening machine including a perforated drum mounted on a frame for rotation about a substantially horizontal axis. Opposite ends of the drum define a bag receiving opening and a bag discharge opening and a material receiving hopper is mounted on the frame below the drum. A conveyor system transports particulate material filled bags into the drum through the bag receiving opening after the bags have been penetrated by a blade mechanism mounted on the frame. Enclosing the entire machine is a vented enclosure that prevents the migration of dust particles into the surrounding environment. After having been opened by the penetrating blade mechanism, the bags are conveyed into the rotating drum and emptied by the tumbling action therein.

14 Claims, 3 Drawing Figures

BAG OPENING APPARATUS

BACKGROUND OF THE INVENTION

This invention relates generally to material handling equipment and, more particularly, to apparatus for opening and emptying bags filled with particulate materials.

Various types of machines have been developed for automatically or semi-automatically opening and emptying particulate material filled bags. Such a machine is disclosed, for example, in U.S. Pat. No. 3,811,586, which is assigned to the assignee of the present application. Although somewhat effective for their intended purposes, prior bag opening and emptying machines suffered either individually or compositely from a number of disadvantages. Included in these disadvantages were the inability to handle bags composed of certain materials, the inability to handle particulate material filled inner bags retained by a protective outer bag, a requirement that bags be received in a particular orientation thereby requiring manual loading of bags into the machine, an inability to handle torn bags, etc.

The object of this invention, therefore, is to provide an improved particulate material filled bag opening and emptying apparatus that obviates the disadvantages present in prior equipment of that type.

SUMMARY OF THE INVENTION

The invention is a bag opening machine including a perforated drum mounted on a frame for rotation about a substantially horizontal axis. Opposite ends of the drum define a bag receiving opening and a bag discharge opening and a material receiving hopper is mounted on the frame below the drum. A conveyor system transports particulate material filled bags into the drum through the bag receiving opening after the bags have been penetrated by a blade mechanism mounted on the frame. Enclosing the entire machine is a vented enclosure that prevents the migration of dust particles into the surrounding environment. After having been opened by the penetrating blade mechanism, the bags are conveyed into the rotating drum and emptied by the tumbling action therein. The thereby released particulate material passes through the perforated walls of the drum into the material receiving hopper.

In a preferred embodiment of the invention, the inner surface of the rotary drum is inclined downwardly between the bag receiving opening and the bag discharge opening so as to promote movement of the bags therebetween. In addition, tumbling of the bags within the drum is enhanced by projections that extend from the inner surface of the rotating drum.

According to one feature of the invention, the penetrating blade mechanism includes a pair of rotary blades lying in substantially the same plane and having closely adjacent overlapping cutting edges that penetrate the particulate material filled bags prior to their entry into the rotating drum. Preferably, the rotary blades are aligned in a vertical plane and the lower blade is disposed in a slot formed between a pair of spaced apart endless conveyor belts that transport the particulate material filled bags through the bag receiving opening of the rotary drum.

According to another feature of the invention, the spaced apart endless belts are formed of a mesh material that allows passage of particulate material emerging from the opened bags and the material receiving hopper extends below the mesh belts so as to receive material therefrom.

Still another feature of the invention is the provision of an auxiliary endless belt conveyor that transports particulate material filled bags from a remote location onto the spaced apart mesh belts that form an integral part of the opening and emptying machine. Since the orientation of the bags on the mesh belts is not critical, the bags can be initially loaded onto the auxiliary belt at a remote location thereby establishing greater flexibility in the positioning of the machine itself.

DESCRIPTION OF THE DRAWINGS

These and other objects and features of the present invention will become more apparent upon a perusal of the following description taken in conjunction with the accompanying drawings wherein.

and

Figure 1:
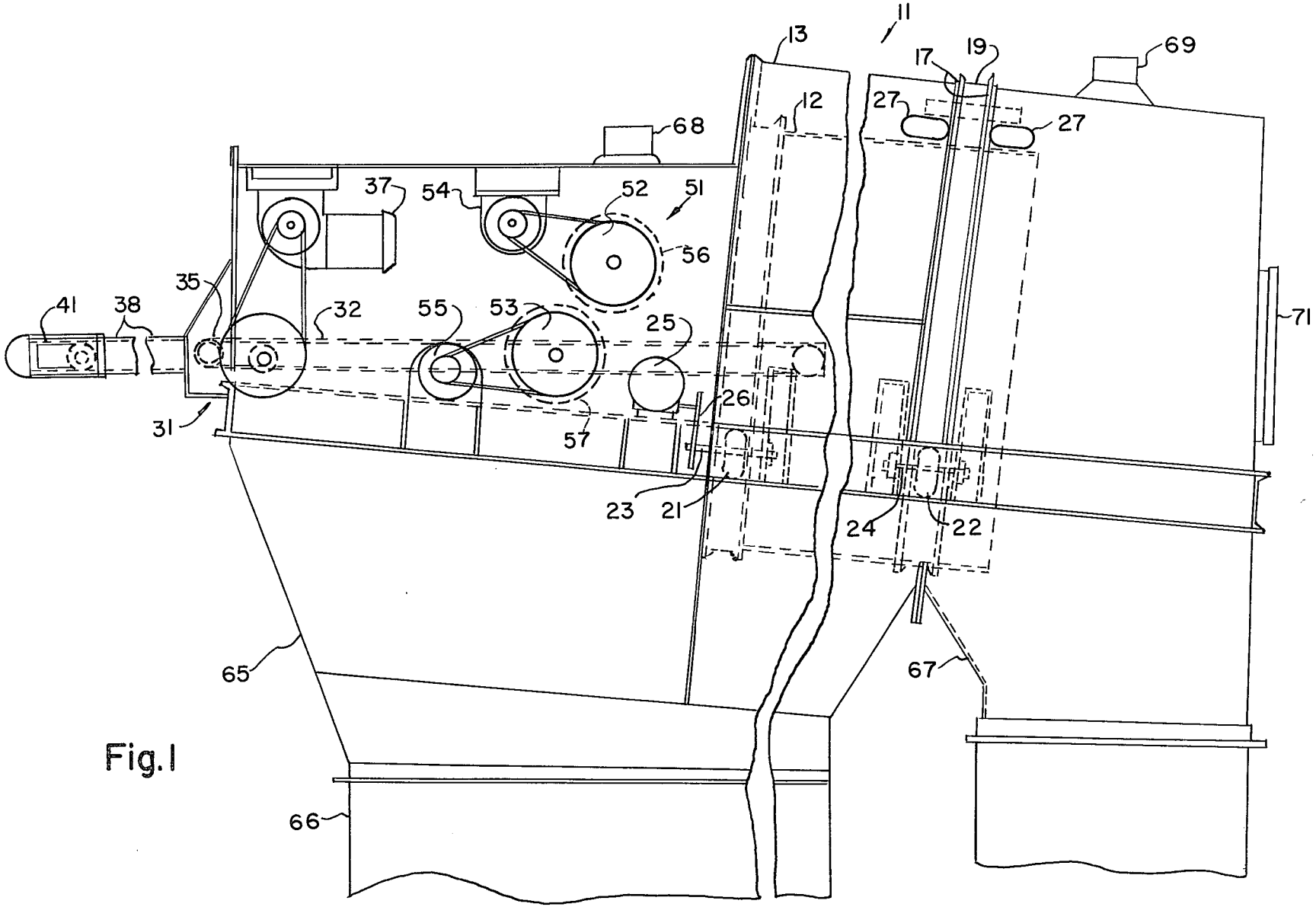
FIG. 1 is a schematic side elevational view of a bag opening and emptying machine according to the invention.
Figure 2:
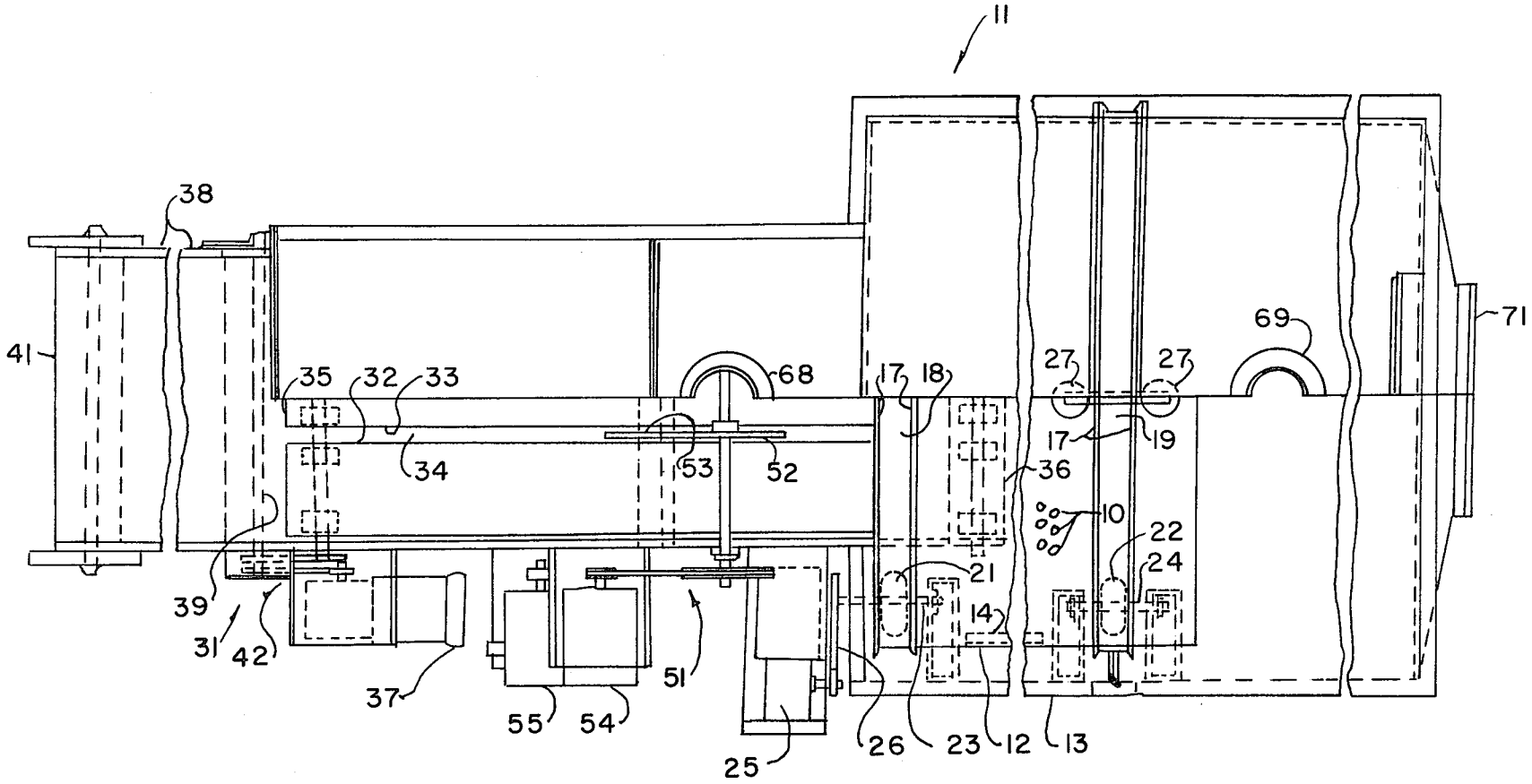
FIG. 2 is a partially cut away plan view of the machine shown in FIG. 1.
Figure 3:
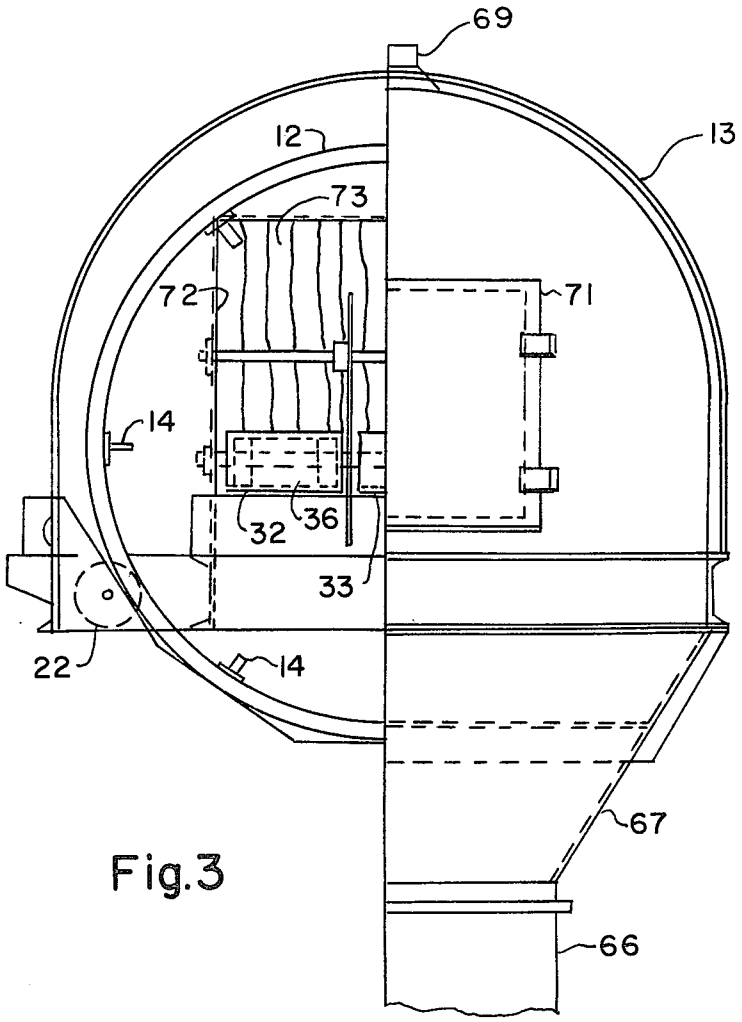

FIG. 3 is a partially cut away end view of the machine shown in FIGS. 1 and 2.

DESCRIPTION OF THE PREFERRED EMBODIMENT

Referring now to the figures, there is shown a machine 11 for opening and emptying bags (not shown) filled with particulate material. The machine 11 includes a hollow drum 12 mounted for rotation about a substantially horizontal axis on a frame assembly 13. The drum 12 is formed of a screen material having openings 10 of sufficient size to accommodate passage of the particulate matter filling the bags being handled by the machine 11. Fixed to the inner surface of the drum 12 at circumferentially spaced locations thereon and extending parallel to the rotational axis thereof are a plurality of T-irons 14. The ends of the drum 12 are open forming at one end thereof a bag receiving opening 15 and at an opposite end thereof a bag discharge opening 16.

Projecting from the outer surface of the drum 12 along opposite ends thereof are annular ridges 17 that form wheel tracks 18 and 19. Vertically supporting one end of the drum 12 is a pair of wheels 21 that ride in the wheel track 18 while the opposite end of the drum 12 is supported by a pair of idler wheels 22 that ride in the wheel track 19. The wheels 21 and 22, respectively, are mounted on shafts 23 and 24 that are supported by the frame assembly 13. One of the wheels 21 serves as a drive wheel and its shaft 23 is coupled to a variable speed motor 25 by a chain and sprocket assembly 26. Energization of the motor 25 produces rotation of the drive wheel 21 which in turn produces rotary motion of the drum 12. The drum 12 is retained axially by a pair of idler wheels 27 that engage the outer surfaces of the annular ridges 17 that form the wheel track 19. As shown in FIG. 1, the drum 12 is inclined downwardly between the bag receiving opening 15 and the bag discharge opening 16 so as to establish a slope for the drum's inner surface. The degree of drum inclination can be adjusted by varying the vertical height of the idler wheels 22.

The machine 11 includes also a conveyor system 31 for conveying particulate material containing bags into the rotary drum 12. Included in the conveyor system 31 is a primary conveyor formed by a pair of parallel endless belts 32 and 33 transversely spaced apart to form a longitudinal slot 34. The belts 32 and 33 are preferably formed of a metallic mesh with interstices of sufficient size to accommodate passage of the particulate material retained in the bags being handled by the machine 11. The mesh belts 32 and 33 are substantially horizontal and include a feed end 35 located externally of the drum 12 and a discharge end 36 that projects through the bag input opening 15 into the interior of the drum 12. A conveyor drive motor 37 is mounted on the frame assembly 13 and is coupled to the mesh belts 32 and 33 so as to produce desired movement thereof. The conveyor system 31 also includes an auxiliary endless belt 38 for conveying particulate material filled bags from a remote location onto the mesh belts 32 and 33. The auxiliary belt 38 includes a discharge end 39 located directly adjacent to the input end 35 of the mesh belts 32 and 33 so as to transmit bags thereto and a loading end 41 adjustable into a vertical position convenient for loading bags to be handled by the machine 11. Preferably, the endless belt 38 includes a surface with a high coefficient of friction so as to facilitate the conveyance of bags from locations at substantially different elevations than the input end 35 of the mesh belts 32 and 33. Movement of the auxiliary belt 38 is provided also by the drive motor 37 which is coupled thereto by a drive coupling mechanism 42.

Also mounted on the frame assembly 13 is a blade mechanism 51 for opening bags being conveyed by the mesh belts 32 and 33 prior to their discharge into the rotary drum 12. The blade assembly 51 includes an upper rotary blade 52 mounted above the mesh belts 32 and 33 and a lower rotary blade 53 mounted in the slot 34 therebetween. As shown in FIG. 2, the blades 52 and 53 lie in a common plane. A drive motor 54 is coupled to the rotary blade 52 so as to produce rotation thereof while a drive motor 55 is coupled to the lower blade 53 so as to produce rotation thereof. As shown in FIG. 1 the cutting edges 56 and 57, respectively, of the rotary blade 52 and 53 are spaced apart but include cutting edge portions that lie in a common horizontal plane, i.e., the lower most edge of the cutting edge 56 extends below the uppermost portion of the cutting edge 57. Thus, portions of the blades 52 and 53 pass through common sections of bags being conveyed by the belts 32 and 33. Enclosing the rotary drum 12 and the primary conveyor system 32, 33 is an enclosure 61 that prevents the escape into the surrounding environment of dust particles created during the emptying of bags by machine 11. The enclosure 61 includes a central housing portion 62 that encloses the rotary drum 12, a front housing portion 63 that encloses the primary conveyor belts 32 and 33 and a rear housing portion 64 that accommodates bags egressing from the bag discharge opening 16 of the rotary drum 12. The lower portions of the middle housing portion 62 and the front housing portion 63 form a tapered product discharge chute 65 that opens into a particulate product receiving receptacle 66. The material receptacle 66 can be equipped with any of a variety of conventional material moving equipment such as screws, belt conveyors, etc. Similarly, the rear housing portion 64 comprises a bottom portion formed as a tapered chute 67 for discharging bags that emerge from the discharge opening 16 after having been emptied into the rotary drum 12. Each of the front and rear housing portions 63 and 64, respectively, are provided with vent openings 68 and 69 that can be connected for communiction with air moving equipment that removes dust particles from the enclosure 61 produced during emptying operations therein. As shown in FIG. 3, the end of the rear housing portion 64 defines an access opening that is closed by a hinged door 71. Similarly, an opening 72 in the front housing portion 63 is covered by a dust flap cover 73 formed by a plurality of flexible vertical strips attached at their upper ends. The cover 73 is automatically dislodged by bags conveyed onto the primary conveyor 32, 33 by the auxiliary conveyor 38 so as to permit entrance of the bags into the enclosure assembly 61.

Prior to operation, the machine 11 is mounted in a convenient location within a facility wherein particulate matter filled bags are to be opened and emptied. The vents 68 and 69 are connected for fluid communication with a suitable air moving system (not shown) that will remove dust particles produced within the housing 13 during bag opening and emptying operations. Next, the loading end 41 of the auxiliary belt 38 is located in a position accessible to particulate matter filled bags that are to be handled by the machine 11. Obviously, both the length of the auxiliary belt 38 and the elevation of the loading end 41 relative to the discharge end 42 thereof can be selected to accommodate existing conditions.

Bags loaded at the loading end 41 are moved by the rough surfaced auxiliary belt 38 to the discharge end 39. Having reached that position, they move through the dust flap cover 73 and are received by the wire conveyor belts 32 and 33. As the bags are moved by the mesh conveyors 32 and 33 toward the entrance opening 15 of the drum 12, they are engaged and penetrated by the cutting edges 56 and 57 respectively, of the upper and lower rotating blades 52 and 53. Because of the vertically overlapped positioning of the cutting edges 56 and 57, each bag that progresses by the cutting blades 52 and 53 is cut completely in half before being discharged by the belts 32 and 33 into the rotating drum 12. It will be apparent, in addition, that the orientation of the bags relative to the blades 52 and 53 is not critical and that the desired separation of the bags into separate halves will occur regardless of the manner in which a bag is received by the conveyors 32 and 33. For that reason, bags need not be accurately positioned on the belts 32 and 33 and can be manually loaded onto the loading end 41 of the auxiliary conveyor 38 at a location substantially remote from the machine 11. Also, the opening system 51 can accommodate double bags, torn bags, and bags formed from a large variety of materials.

After passing through the opening mechanism 51, the open bags are discharged by the belts 32 and 33 into the rotating drum 12. The tumbling action produced within the rotating drum 12 empties the bags of particulate matter content which passes through the orifices 10 and is guided by the chute 65 into the material hopper 66. This tumbling action is enhanced by the T-iron projections 14 that retain the bags for a partial revolution of the drum 12 before allowing them to fall back into a lower portion thereof. During this operation, the bags move slowly from the input end 15 toward the output end 16 of the rotating drum 12. This movement of the bags is caused by the predetermined downward inclination of the drum between the input and discharge openings thereof. Having reached the discharge opening 16, the then fully emptied bag portions are dropped into the discharge chute 67 and are guided thereby either into a bag accumulation area or into a suitable bag collection mechanism (not shown). The overall rate at which the bags are emptied and migrate through the drum 12 is determined by the drums rotational speed and the drum inclination that is in turn established by the vertical position of the idler wheels 22. Also, the size of the orifices 10 in the drum 12 are selected to accommodate the largest particles retained by the bags being processed.

Obviously, many modifications and variations of the present invention are possible in light of the above teachings. It is therefore to be understood that within the scope of the appended claims the invention can be practised otherwise than as specifically described.

What is claimed is:

1. A bag opening apparatus comprising:

a frame means;

a perforate drum mounted on said frame means for rotation along a substantially horizontal axis, one end of said drum defining a bag receiving opening and an opposite end thereof defining a bag discharge opening;

drum drive means for producing rotation of said drum;

a material receiving hopper mounted on said frame below said drum;

conveyor means for conveying particulate material filled bags into said drum through said bag receiving opening;

blade means mounted on said frame means and disposed so as to penetrate bags while said bags are being conveyed by said conveyor means, said blade means comprising a pair of rotary blades lying in substantially the same plane and having cutting edge portions lying in a common plane transverse to said same plane; and substantially parallel to said conveyor means and enclosure means substantially enclosing said drum.

2. An apparatus according to claim 1 wherein the inner surface of said drum is inclined downwardly between said bag receiving opening and said bag discharge opening so as to promote movement of the bags therebetween.

3. An apparatus according to claim 2 including tumbler means defined on said inner surface of said drum and adapted to induce tumbling motion of the bags within said drum during rotary movement thereof.

4. An apparatus according to claim 3 wherein said tumbler means comprise projections extending from said inner surface.

5. An apparatus according to claim 1 wherein said conveyor means comprises an endless belt composed of a pair of longitudinal sections transversely separated to form a slot, and one of said rotary blades is disposed in said slot and the other of said rotary blades is disposed above said endless belt.

6. An apparatus according to claim 5 wherein said endless belt is composed of a mesh material having interstices for transmitting particulate material emerging from the bags, and said hopper extends below said endless belt.

7. An apparatus according to claim 6 wherein said conveyor means further comprises an auxiliary endless belt disposed to transport the bags from a remote location onto said mesh endless belt.

8. An apparatus according to claim 7 wherein the inner surface of said drum is inclined downwardly between said bag receiving opening and said bag discharge opening so as to promote movement of the bags therebetween.

9. An apparatus according to claim 8 including tumbler means defined on said inner surface of said drum is adapted to induce tumbling motion of the bags within said drum during rotary movement thereof.

10. An apparatus according to claim 9 wherein said tumbler means comprise projections extending from said inner surface.

11. An apparatus according to claim 10 wherein said enclosure means encloses said mesh endless belt and defines a vent opening for exhausting dust particles from said enclosure means.

12. An apparatus according to claim 11 wherein said enclosure means defines an entrance between said auxiliary endless belt and said mesh endless belt, and said entrance is covered by a door that opens automatically in response to movement of a bag from said auxiliary belt to said mesh belt.

13. A bag opening apparatus comprising:

a frame means;

a perforate drum mounted on said frame means for rotation along a substantially horizontal axis, one end of said drum defining a bag receiving opening and an opposite end thereof defining a bag discharge opening;

drum drive means for producing rotation of said drum;

a material receiving hopper mounted on said frame below said drum;

conveyor means for conveying particulate material filled bags into said drum through said bag receiving opening, said conveyor means extending through said bag receiving opening into the interior of said drum;

blade means mounted on said frame means and disposed so as to penetrate bags being conveyed by said conveyor means; and enclosure means substantially enclosing said drum.

14. An apparatus according to claim 1 wherein said conveyor means extends through said bag receiving opening into the interior of said drum.

* * * * *